US005421535A

United States Patent [19]

Hemmert et al.

[11] Patent Number: 5,421,535

[45] Date of Patent: Jun. 6, 1995

[54] METHOD AND APPARATUS FOR AUTOMATICALLY WINDING SCRAP METALLIC STRIP MATERIAL

[75] Inventors: Dave P. Hemmert, Wapakoneta; Robert L. Clune, New Bremen, both of Ohio

[73] Assignee: Stamco Division, Monarch Machine Tool Co., New Bremen, Ohio

[21] Appl. No.: 27,808

[22] Filed: Mar. 8, 1993

[51] Int. Cl.[6] ..... B65H 18/08; B65H 20/06

[52] U.S. Cl. ..... 242/471; 242/524.1; 242/532.7; 242/535.4; 242/548

[58] Field of Search ..... 242/56.2, 56.4, 56.5, 242/56.6, 56.7, 56 R, 78, 78.1, 78.3, 81, 471, 535.4, 524.1, 525, 525.3, 525.4, 525.5, 525.6, 525.7, 527, 532.7, 539, 548

[56] References Cited

U.S. PATENT DOCUMENTS

| | | | |
|---|---|---|---|
| 2,387,386 | 10/1945 | Cohn | 242/56.5 |
| 2,615,646 | 10/1952 | Disler | 242/78 |
| 3,273,819 | 9/1966 | Sivilotti | 242/78.1 |
| 3,777,998 | 12/1973 | Jores et al. | 242/56.2 |
| 3,871,290 | 3/1975 | Verboom | 242/56.2 X |
| 4,466,578 | 8/1984 | Shibuya et al. | 242/548 X |
| 4,550,881 | 11/1985 | Boardman | 242/56 R |
| 5,152,471 | 10/1992 | Goerner | 242/532.7 X |

FOREIGN PATENT DOCUMENTS

| | | | |
|---|---|---|---|
| 2130543 | 12/1971 | Germany | 242/56.2 |
| 0118641 | 7/1984 | Japan | 242/56 R |

*Primary Examiner*—John M. Jillions

*Attorney, Agent, or Firm*—Thompson, Hine and Flory

[57] ABSTRACT

A method and apparatus for automatically winding ribbons of edge trim metallic scrap into a compact ball generated by a side trimming machine including a scrap collection pit located behind the side trimming machine, a conveyor system for transporting the metallic scrap from the collection pit to a winding machine having a tapered mandrel around which the metallic scrap is wound. The scrap winding machine further includes an ironing roll which compacts the metallic scrap as it is wound and a ball ejection means which removes the compacted ball from the winding machine. The conveyor system includes a first sheave and cable system located in the collection pit and a second sheave and cable system extending at an incline from the pit to the winding machine. The sheave and cable systems include a plurality of spring loaded drag hooks for engaging the metallic scrap. The winding machine further includes a parting shear located on an edge of a trailing door which severs the ribbon as the trailing door is closed. The system further includes a hood attached to the side trimming machine for deflecting the trimmed metallic scrap into the collection pit. The entire system is fully automated and can be operated without human intervention.

19 Claims, 2 Drawing Sheets

METHOD AND APPARATUS FOR AUTOMATICALLY WINDING SCRAP METALLIC STRIP MATERIAL

BACKGROUND OF THE INVENTION

This invention generally relates to metallic slitting and edge trimming apparatuses and, more particularly, to an apparatus for automatically winding edge trim scrap metallic sheet material.

Slitting and edge trimming of strip sheet metal is accomplished by slitting devices which include pairs of cooperating upper and lower circular cutting knives between which sheet metal is passed. A coiled strip of metallic sheet may be edge trimmed continuously in this fashion to a desired width by passing the strip between two pairs of knives, known as side trimmers, positioned adjacent the lateral edges of the strip. Thus, the sheet is reduced in width by removing continuous ribbons of metal from the longitudinal edges of the sheet.

The ribbons of metal which are removed from the strip sheet come away from the side trimmers either flat or corkscrewed, and sometimes come away from the trimmers in segments if the incoming strip has edge cracks. These edge trimmings, known as scrap, must be removed from the side trimmer work station. The efficient handling and removal of this scrap has become problematic.

A previous method of handling sheet metal scrap is to wind the scrap into a compact ball which is later reclaimed to make strip. The ribbons of scrap are fed into a holding area behind the side trimmer and at the operator's discretion are drug out of the holding area by a rotating mandrel of a scrap baller and compressed into a compact ball with the aid of a heavy ironing roll.

When the scrap ball reaches a predetermined size, the rotation of the scrap baller mandrel is stopped and the operator cuts the incoming strands. This scrap ball is then stripped off the mandrel by a traversing housing and the scrap ball is ejected out of the ballet by an eject device.

When the scrap stream is discontinuous or when the ball is ejected, the operator must carry the scrap strands from the holding area to the scrap baller mandrel for starting a new ball. This method of winding scrap strands is time-consuming because the scrap baller cannot be operated continuously, but rather must be stopped to cut the incoming strands, strip the scrap ball, and feed the strands to start a new ball. Therefore, a need exists for an improved apparatus and method for the winding of metallic scrap strip that eliminates the problems associated with previous scrap handling techniques, eliminates human intervention in the handling process, and provides for an automated system for winding the material.

SUMMARY OF THE INVENTION

The present invention is an apparatus for automatically winding ribbons of metallic edge trim scrap into a compact ball without manual assistance. The apparatus includes a scrap hood to deflect scrap ribbons coming away from the side trimmer knives, and a scrap enclosure located in a pit behind the side trimmer that collects the scrap material. The invention includes an inclined conveyor, located in the scrap enclosure, which conveys scrap upwardly from the pit and includes drag hooks.

The invention also includes an endless conveyor, located on the floor of the pit, having drag hooks which move to convey scrap to the inclined conveyor. This drag hook traverse system continuously traverses the pit at a speed somewhat slower than the strip speed through the side trimmers. The drag hooks feed the scrap ribbons onto the rotating mandrel of the scrap baller and the ribbons are wound into a ball. The scrap ribbons are compressed into a compact ball by an ironing roll located on the scrap baller.

At the completion of the scrap ball, the drag hook traverse system is stopped, the ironing roll is retracted, and a parting shear severs the scrap ribbons over the scrap baller. A trailing door on the scrap baller behind the shear blade simultaneously closes the opening over the scrap baller. The scrap ball is then stripped off the mandrel by a traversing housing and ejected out of the baller by an eject device.

Once the scrap ball is removed, the emptied traverse housing is returned to a closed position. The scrap baller mandrel begins rotation, and the shear blade trailing door is opened. The scrap hook traverse system once again begins moving scrap towards the baller, and the scrap is automatically started around the rotating mandrel. The entire scrap removal operation can be automated so that the scrap ball ejection takes place when the scrap ball is wound to the optimum size. Human intervention is eliminated and cameras can be utilized to allow the operator to monitor the operation remotely.

Accordingly, it is an object of the present invention to provide an automated method for winding ribbons of edge trim metallic scrap; a method for winding ribbons of edge trim metallic scrap into a compact ball without operator assistance; and a method for winding metallic scrap which eliminates the hazards accompanied by operator proximity to ribbons and tangles of ribbons of side trim metallic scrap.

These and other features and advantages of the present invention will be better understood by reference to the following detailed description, the accompanying drawings and the appended claims.

DETAILED DESCRIPTION

Figure 1:
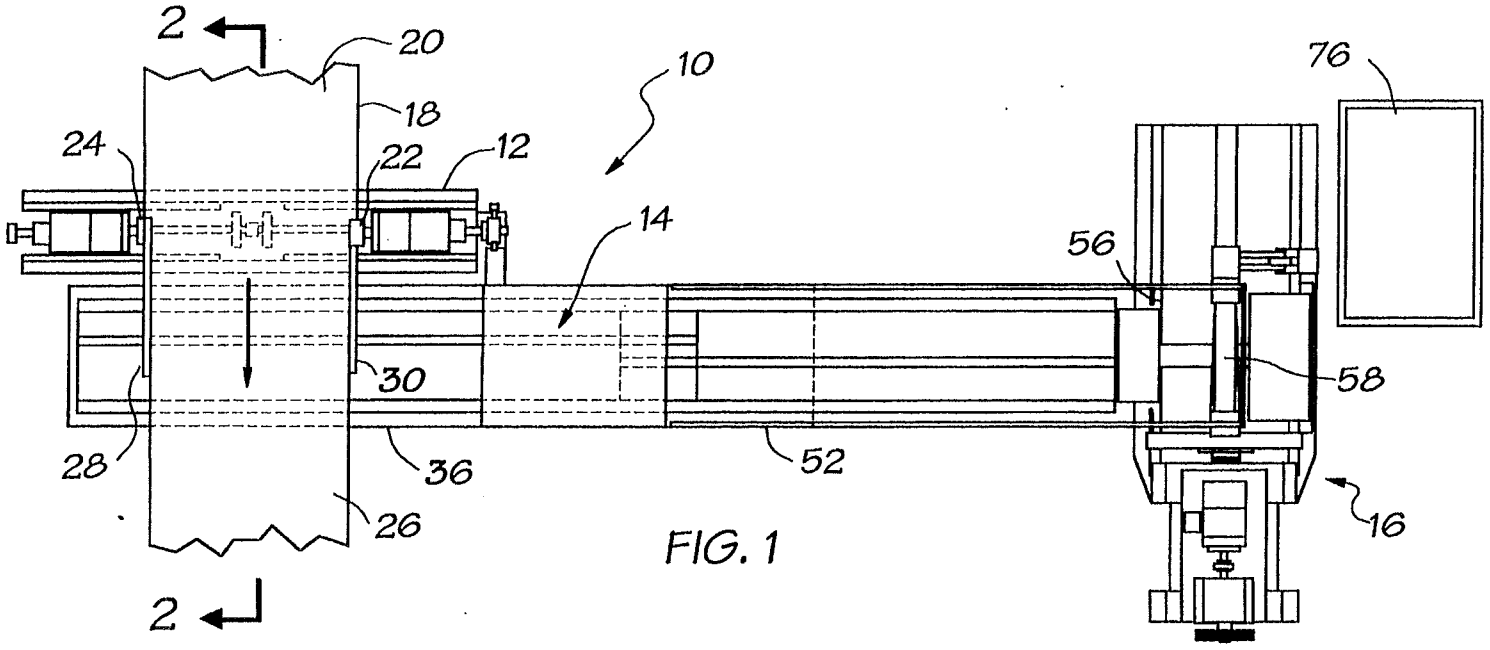
FIG. 1 is a top view of a scrap handling system of the present invention.
Figure 2:
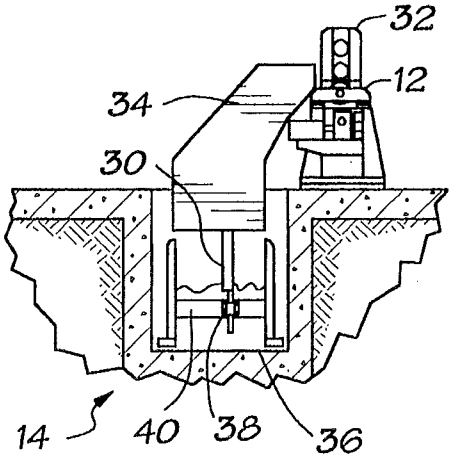
FIG. 2 is a side sectional view of the scrap handling system taken along line 2—2 of FIG. 1.
Figure 3:
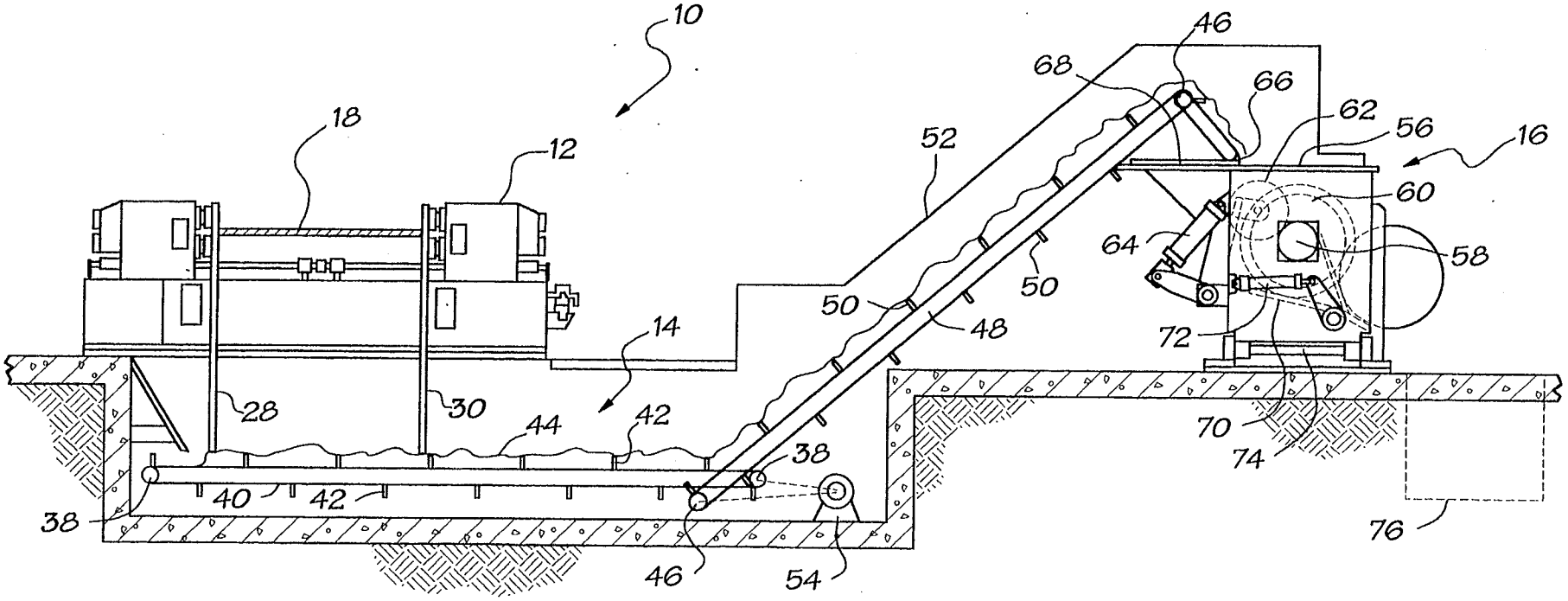
FIG. 3 is a front view of the scrap handling system of FIG. 1.

A scrap ribbon winding device, generally designated 10 of the present invention, is shown in FIGS. 1–3, and includes a side trimming machine 12, a scrap enclosure 14 and a scrap balling machine 16.

A coiled roll of metallic strip 18 is continuously cut by the side trimming machine 12 to the required width by passing incoming strip 20 between two pairs of mating, rotating side trimmer knives 22, 24 such that the outgoing strip 26 has continuous ribbons of metal 28, 30 removed from each edge of the strip 18.

A scrap hood 32 is placed behind trimming knives 22, 24 to direct ribbons 28, 30 downwardly into a second scrap hood 34 which further directs ribbons 28, 30 into the scrap enclosure 14.

The scrap enclosure 14 is in a pit 36 below floor level located behind the side trimming machine 12. Located in the floor of the scrap enclosure 14 is a sheave 38 and cable 48 system containing a plurality of spring loaded drag hooks 42 which grabs ribbon 28, 30 collected in the scrap enclosure 14 and translate ribbons 28, 30, known as scrap 44, towards the scrap balling machine 16. A chain system, belt system, or other type system could be substituted for the sheave and cable system.

A second sheave 46 and cable 48 system similarly containing a plurality of spring loaded drag hooks 50, extends out of the pit 36 at an incline up to the top of the scrap balling machine 16. Sheave 46 and cable 48 system translate the scrap 44 out of the pit 36 and into the scrap balling machine 16. A three-sided shield 52 is placed over sheave 46 and cable 48 system to prevent any scrap 44 from falling off of the system. Both sheave and cable systems are driven by a single driver 54.

Once scrap 44 makes it to the top of the incline sheave and cable system, it is dumped into the scrap balling machine 16 through an opening 56 in the top of the machine. Once inside the scrap balling machine 16, the scrap 44 is wound around a tapered mandrel 58 into a scrap ball 60. Scrap ball 60 is compressed by an ironing roll 62, which is urged against the scrap ball by a pneumatic cylinder 64. At the completion of the scrap ball 60, the sheave and cable systems are stopped, and the ironing roll is retracted. A parting shear 66 located on the end of a trailing door 68 located at the opening 56 of the scrap balling machine 16 severs the scrap ribbons as the trailing door 68 simultaneously closes the opening 56 over the scrap balling machine 16.

The completed scrap ball 60 is removed from the scrap balling machine by withdrawing the tapered mandrel 58 from the scrap ball 60. The scrap ball is then ejected from the balling machine sidewardly by means of a panel 70 which is pivoted by a hydraulic cylinder 72 and the scrap ball exits the scrap balling machine through housing 74 which opens into a scrapped ball eject pit 76.

Once the scrap ball has been ejected, housing 74 returns to a closed position, the tapered mandrel 58 begins to rotate, the trailing door 68 opens, and the sheave and cable systems are activated to move scrap 44 towards the balling machine 16. Scrap 44 is fed into the balling machine and automatically started around the tapered mandrel 58.

The preceding description has been presented with reference to a presently preferred embodiment of the invention shown in the drawings. Workers skilled in the art and technology to which this invention pertains will appreciate that alterations and changes in the described structure can be practiced without departing from the spirit, principals and scope of this invention.

What is claimed is:

1. An apparatus for handling ribbons of metal trimmed from the edge of sheet material by a side trimming machine comprising:

means for collecting said ribbons;

means for winding the ribbons into a compact ball;

at least one hood means for deflecting said ribbons into said collecting means;

means for automatically guiding said ribbons to said winding means for initial engagement therewith, whereby said winding means removes said ribbons from said collecting means and winds said ribbons into said ball, all without human intervention; and means for shearing said ribbons after said ribbons are wound into said ball.

2. The apparatus of claim 1 wherein said collection means includes a pit located behind said side trimming machine.

3. The apparatus of claim 2 wherein said hood means for deflecting said ribbons, deflects said ribbons into said pit.

4. The apparatus of claim 3 wherein said hood deflecting means comprises a hood extending downwardly from said side trimming machine into said pit.

5. The apparatus of claim 1 wherein said winding means comprises a scrap balling machine having a tapered mandrel around which said ribbons are wound.

6. The apparatus of claim 5 wherein said scrap balling machine further includes an ironing roll for compacting said wound ribbons and a ball ejection means for removing said wound ribbons.

7. The apparatus of claim 1 wherein said removing means comprises a conveyor system.

8. An apparatus for handling ribbons of metal trimmed from the edge of sheet material by a side trimming machine comprising:.

means for collecting said ribbons;

means for winding the ribbons into a compact ball;

means for automatically removing said ribbons from said collecting means to said winding means without human intervention, said removing means comprising a conveyor system;. and means for shearing said ribbons after said ribbons are wound into said ball, wherein said conveyor system includes a first sheave and cable system located in said collecting means and a second sheave and cable system extending at an incline from said collecting means to said scrap balling machine.

9. The apparatus of claim 8 wherein said first and second sheave and cable systems include a plurality of drag hooks for engaging said ribbons.

10. The apparatus of claim 9 wherein said drag hooks are spring loaded.

11. The apparatus of claim 8 wherein said second sheave and cable system includes a shield located around said system for retaining said ribbons.

12. An apparatus for handling ribbons of metal trimmed from the edge of sheet material by a side trimming machine comprising:

means for collecting said ribbons;

means for winding the ribbons into a compact ball;

means for automatically removing said ribbons from said collecting means to said winding means without human interventions and means for shearing said ribbons after said ribbons are wound into said ball, wherein said shearing means comprises a parting shear located on an edge of a trailing door of said balling machine such that said parting shear severs said ribbons as said trailing door closes.

13. A system for winding ribbons of metal trimmed from the edges of sheet material by a side trimming machine comprising:

a ribbon collection pit located behind said side trimming machine;

a scrap balling machine having a tapered mandrel around which said ribbons are wound into a ball;

said scrap balling machine further includes an ironing roll for compacting said scrap ball and a ball ejection means for removing said scrap ball from said balling machine;

a conveyor system for moving said ribbons from said collection pit to said scrap balling machine;

said conveyor system including a first sheave and cable system located in said pit and a second sheave and cable system extending at an incline from said pit to said balling machine, said first and second sheave and cable systems including a plurality of drag hooks for engaging said ribbons; and a parting shear located on an edge of a trailing door on said scrap balling machine such that said parting shear severs said ribbons as said trailing door closes when said compact ball is completely wound.

14. The system of claim 13 wherein said side trimming machine includes a hood for deflecting said ribbons into said collection pit.

15. The system of claim 13 wherein said second sheave and cable system includes a shield located around said system for retaining said ribbons as said ribbons are moved from said collection pit to said scrap balling machine.

16. The system of claim 13 wherein said drag hooks are spring loaded.

17. A method for automatically winding ribbons of edge trim metallic scrap into a compact ball without human intervention comprising the steps of:

shearing said ribbons from metallic sheet material;

deflecting said ribbons into a scrap enclosure pit;

driving a first conveyor system for moving said ribbons within said scrap enclosure;

driving a second conveyor system for moving said ribbons from said scrap enclosure to a scrap balling machine;

winding said ribbons around a rotating mandrel located inside said balling machine;

stopping said conveyor system and shearing said ribbons; and ejecting said compact ball.

18. The method of claim 17 wherein said shearing step comprises closing a trailing door on said balling machine having a parting shear located on a edge of said trailing door.

19. The method of claim 18 further comprising the steps of:

opening said trailing door; and restarting said conveyor system to wind a second scrap ball.

* * * * *